US008552822B2

(12) United States Patent
Prestini

(10) Patent No.: US 8,552,822 B2
(45) Date of Patent: Oct. 8, 2013

(54) MULTI-PHASE MEDIUM VOLTAGE CONTACTOR

(75) Inventor: Osvaldo Prestini, Nembro (IT)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/379,631

(22) PCT Filed: Jun. 22, 2010

(86) PCT No.: PCT/EP2010/058852
§ 371 (c)(1),
(2), (4) Date: Jan. 30, 2012

(87) PCT Pub. No.: WO2011/000744
PCT Pub. Date: Jan. 6, 2011

(65) Prior Publication Data

US 2012/0119856 A1 May 17, 2012

(30) Foreign Application Priority Data

Jul. 1, 2009 (EP) ..... 09164343

(51) Int. Cl.
*H01H 75/00* (2006.01)
*H01H 77/00* (2006.01)
*H01H 83/00* (2006.01)

(52) U.S. Cl.
USPC ..... 335/8; 335/238; 218/154

(58) Field of Classification Search
USPC ..... 335/8, 16, 27, 164, 173, 186, 238; 218/118–120, 140, 152–154; 361/71, 72, 361/115; 200/18, 329, 400
See application file for complete search history.

(56) References Cited

U.S. PATENT DOCUMENTS

| | | | | |
|---|---|---|---|---|
| 4,625,189 | A * | 11/1986 | Lazar et al. | 335/10 |
| 5,103,364 | A * | 4/1992 | Kamp | 361/72 |
| 5,124,678 | A * | 6/1992 | Yamat et al. | 335/9 |
| 6,852,939 | B2 * | 2/2005 | Rhein et al. | 218/154 |
| 2006/0162194 | A1 | 7/2006 | Wang | |
| 2007/0252667 | A1 | 11/2007 | Zhou et al. | |

* cited by examiner

*Primary Examiner* — Bernard Rojas
(74) *Attorney, Agent, or Firm* — Novak Druce Connolly Bove + Quigg LLP

(57) ABSTRACT

A multi-phase Medium Voltage Contactor (100) comprising:
for each phase, a fixed contact (103) and a movable contact (104) positionable between an open position, in which it is operatively disconnected from the fixed contact (103), and a closed position in which it is operatively connected to the fixed contact (103);
an electromagnetic actuator (10) operatively connected to the movable contact (104) and positionable between a first open position corresponding to the open position of the movable contacts (104), and a second closed position corresponding to the closed position of the movable contacts (104);
a manual opening device (20) operatively connected to the electromagnetic actuator.
The manual opening device (20) comprises a kinematic mechanism having:
an operating shaft (8);
first lever means (3) movable by the operating shaft (8);
second lever means (4) movable by the first lever means (3) and operatively coupled to the electromagnetic actuator,
blocking means (5) movable by the first lever means (3) between a first position in which the blocking means (5) lock the second lever means (4) and a second position in which the second lever means (4) are released thereby determining the positioning of the electromagnetic actuator (10) from said closed position into said open position.

22 Claims, 15 Drawing Sheets

MULTI-PHASE MEDIUM VOLTAGE CONTACTOR

CROSS REFERENCE TO RELATED APPLICATIONS

This application is a National Phase filing under 35 U.S.C. §371 of PCT/EP2010/058852, filed Jun. 22, 2010, which claims priority to Patent Application No. 09164343.7, filed in Europe on Jul. 1, 2009. The entire contents of each of the above-applications are incorporated herein by reference.

The present invention relates to a multi-phase medium voltage contactor.

For the purpose of the present application, the term medium voltage is referred to applications in the range between 1 KV and 50 KV.

It is well known the use in electric systems of two different types of switching devices; a first type is constituted by the so-called protection devices, typically circuit breakers, which are basically suitable for carrying—for a specified time—and breaking currents under specified abnormal circuit conditions, namely short circuits; a second type is constituted by manoeuvring switching devices, such as contactors like the one of the present invention, which are capable of making, carrying and breaking currents under normal circuit conditions including overload conditions. Such contactors, widely used for example to switch on/off electric motors, are required to satisfy a number of conditions which are important to guarantee the proper functional performances during their service life in electrical networks; for example, switching off manoeuvres should be carried out in due time, normally as quickly as possible, in order to prevent possible damages to the equipment, the actuating mechanism should be designed so as to ensure an adequate operational repeatability and an optimized reliability, and so on.

A multi-phase medium voltage contactor of the vacuum interrupter breaking type is also known. It can operate in particularly difficult environments, such as in industry, service sector, marine sector, etc. It is suitable for control and protection of motors, transformers, power factor correction banks, switching systems, etc. When fitted with suitable fuses, it can be used in circuits with fault levels up to 1000 MVA.

Such a multi-phase medium voltage contactor presents, for each phase, a vacuum bulb or bottle inside which electrical contacts are placed. Such contacts comprise a fixed contact and an associated mobile contact which is positionable between an open position, in which it is operatively separated from the fixed contact, and a closed position, in which it is operatively connected to the fixed contact.

The movable contacts of the various phases are actuated to move between the open and closed positions by means of an actuator, typically an electromagnetic actuator provided in most cases with permanent magnets.

Two ways of operations are mainly known for opening/closing maneuvers, namely:

"single command operated multi-phase medium voltage contactor", which is such that closing takes place by supplying auxiliary power to a special input of the electromagnetic actuator, and opening takes place when the auxiliary power is either voluntarily cut-off (by means of a command) or involuntarily (for lack of an auxiliary power during the installation);

"double command operated multi-phase medium voltage contactor", which is such that opening and closing take place by supplying the input of the closing command of the contactor in an impulsive way.

In the first way, if the feeding auxiliary power is absent, e.g under fault conditions, or when the electromagnetic actuator is malfunctioning for any reason, for instance due to breakage of any component, manual opening operations are required. To this end, it is necessary to switch off voltage thus putting out of service various loads. Alternatively, it is also possible to open the actuator manually when voltage is still present and the loads fed ("on load" condition). This is normally a tricky operation, because opening operations have to be realized within determined time limits. Unfortunately, with manually driven operations, it is not possible so far to ensure a 100% reliability; indeed a wrong opening speed may cause damages to the loads or to the contactor itself.

It is therefore object of the present invention to provide a multi-phase medium voltage contactor capable to overcome this technical problem, and in particular to manually open the electromagnetic actuator with a desired speed without putting the loads out of service. According to the invention, this object is achieved by means of a multi-phase Medium Voltage Contactor comprising:

- for each phase, a fixed contact and an associated movable contact positionable between an open position, in which it is operatively disconnected from said fixed contact, and a closed position, in which it is operatively connected to said fixed contact;
- an electromagnetic actuator operatively connected to said movable contact and positionable between a first, open position corresponding to the open position of said movable contacts, and a second, closed position corresponding to said closed position of said movable contacts;
- a manual opening device operatively connected to said actuator;

wherein said manual opening device comprises a kinematic mechanism having:

- an operating shaft;
- first lever means movable by said operating shaft;
- second lever means movable by said first lever means and operatively coupled to said electromagnetic actuator,
- blocking means movable by said first lever means between a first position in which said blocking means lock said second lever means and a second position in which said second lever means are released thereby determining the positioning of said electromagnetic actuator from said closed position into said open position.

In this way, the speed of positioning the electromagnetic actuator from the closed position to the open position is constant and totally independent from the manual actuation speed.

Preferably, the blocking means present a profile with a cam and a step, so that said second lever means are blockable by engagement with said cam and unblockable at the reaching of said step. In this way, the speed of positioning of the electromagnetic actuator is determined by the presence of the sequence of cam and step.

Preferably, the blocking means comprise a protuberance engageable to/draggable by said first lever means. In this way, it is easy for the blocking means to be moved so as the step is reached. No specific actuators for the movement of the blocking means are required, thus achieving a particular simplicity.

Preferably, the kinematic mechanism comprises primary elastic means, in particular a primary spring, which is interposed between said first lever means and said second lever means. In this way, the primary spring is capable to move the second lever means in a very simple way.

Preferably, the primary elastic means are compressible by said first lever means so as to store elastic energy. At least partially, the elastic energy stored by said primary elastic means is capable to determine a snap movement of said second lever means. The snap movement is clearly independent from the manual action exerted onto the operating shaft, because said snap movement is due to the elastic features of the primary elastic means.

Preferably, the primary elastic means are such that, partially, said elastic energy is capable to determine a return movement of said first lever means and second lever means. In this way it is possible that, when a user does not apply any force and the opening operation is completed, the kinematic mechanism returns back to its initial position without any necessity of forcing a countermovement to the kinematic mechanism.

Preferably, the kinematic mechanism comprises secondary elastic means, preferably a secondary spring, having a first end coupled to said blocking means and a second end coupled to said second lever means. The secondary elastic means are capable to help the return movement of said kinematic mechanism, while they not impede, or only minimally, the opening movement.

Preferably, the secondary elastic means are capable to determine a return movement of the blocking means and a consequent return movement of the second lever means by engagement of said second lever means with said blocking means.

Preferably, said protuberance is placed eccentrically with respect to said blocking means, said first lever means comprising a slot within which said protuberance is movable. In this way, both the following situations are possible:

- a relative movement between the slot and the protuberance, such that one between the first lever means and said blocking means rotates while the other one is still;
- a coupled movement of both the slot and the protuberance, such that the first lever means and blocking means rotate together.

It has to be noticed that in this way, advantageously, it can happen that, after an initial relative movement between said first lever means and said blocking means, one of them is capable to drag the other one.

Further characteristics and advantages of the invention will emerge from the description of preferred, but not exclusive embodiments of a Medium Voltage line switch contact arrangement according to the invention, non-limiting examples of which are provided in the attached drawings, wherein.

With reference to the figures, a multi-phase medium voltage contactor is indicated by the overall reference number 100, and is illustrated only by way of example, as a three-phase contactor.

Figure 1:
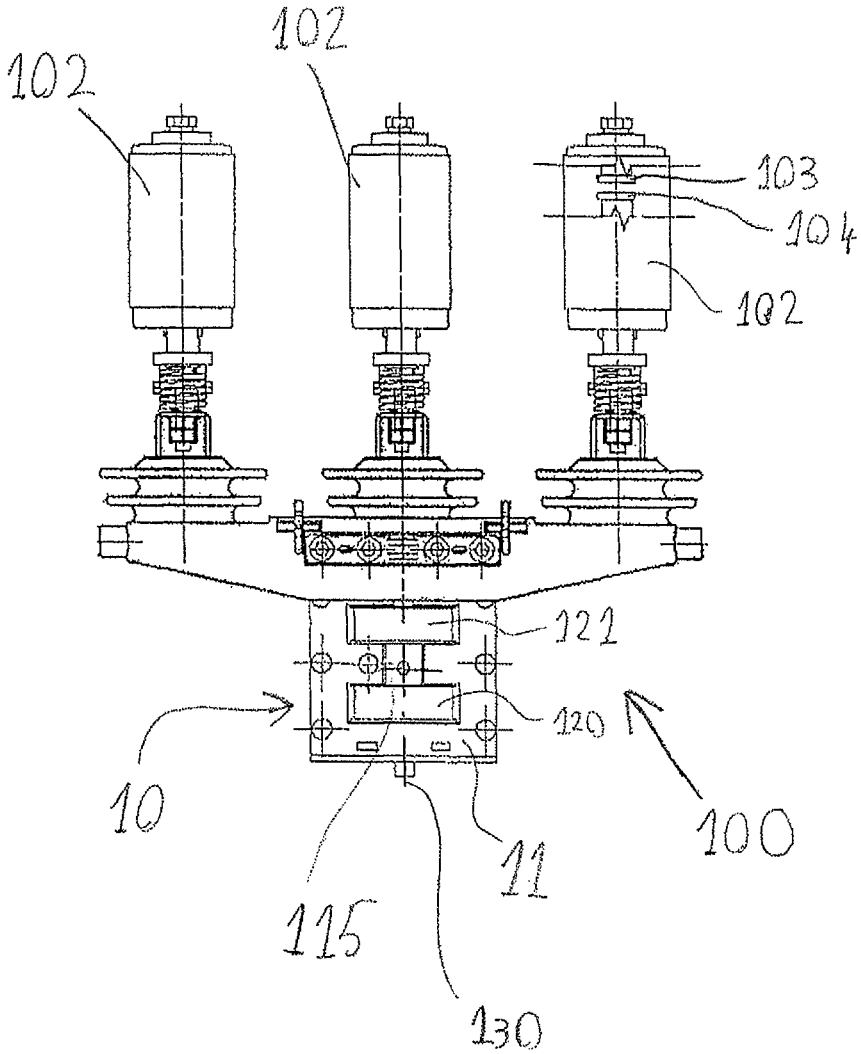
FIG. 1 is a partial side view of a multi-phase medium voltage contactor according to the present invention.
Figure 2:
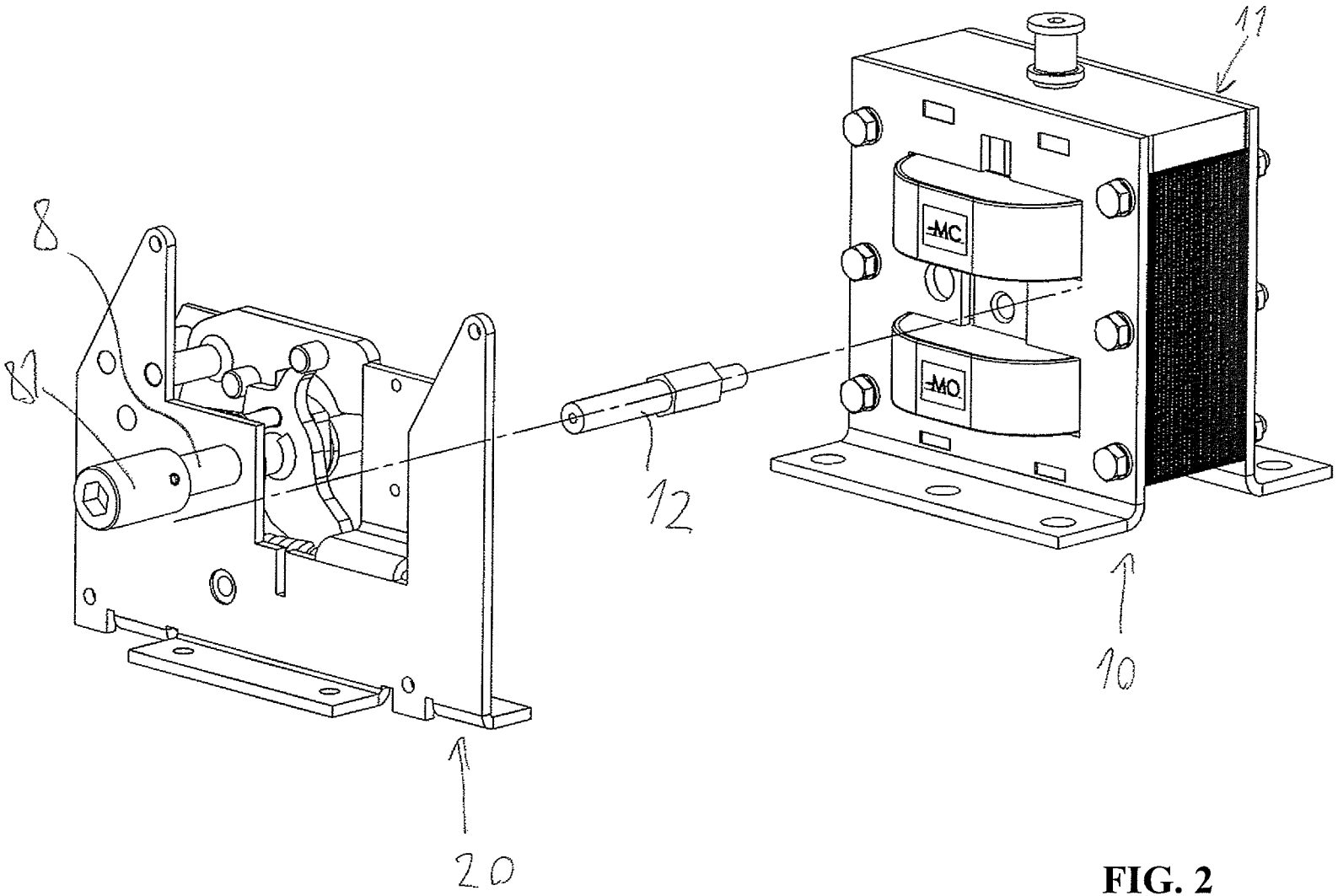
FIG. 2 is a three-dimension exploded view of a part of the multi-phase medium voltage contactor according to the present invention.
Figure 3:
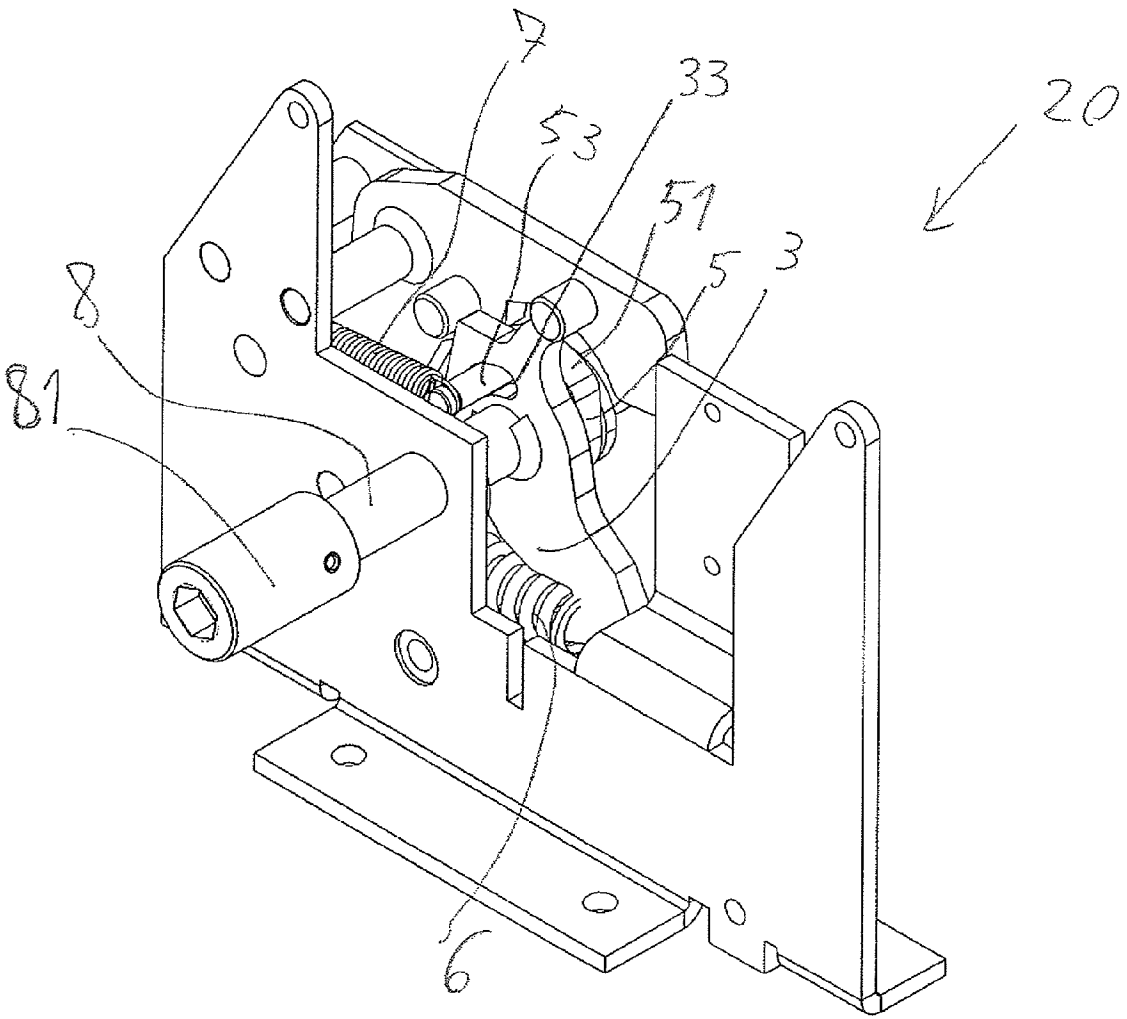
FIG. 3 is a three-dimension enlarged view of a part of the multi-phase medium voltage contactor of FIG. 1.
Figure 4:
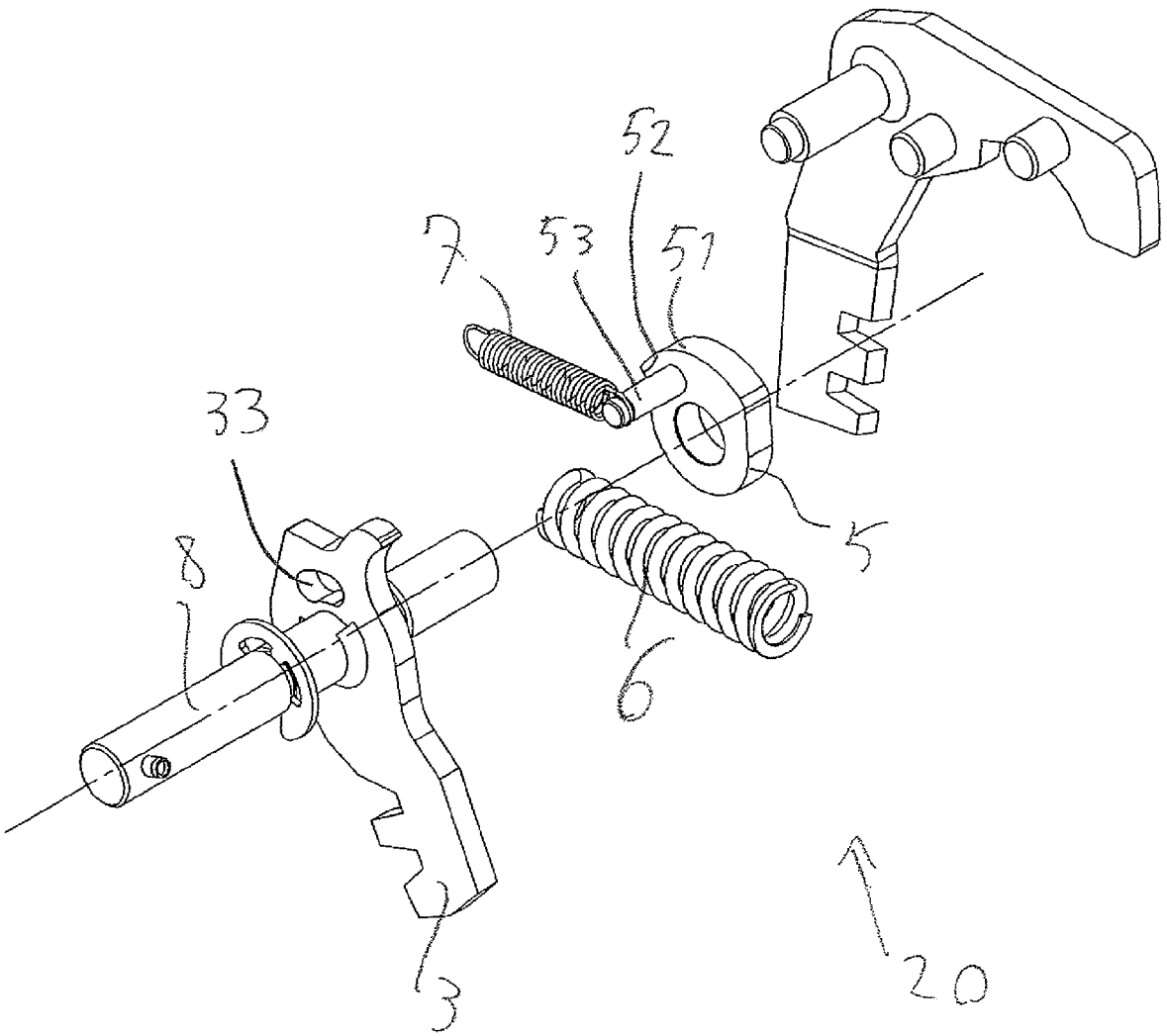
FIGS. 4 and 5 are three-dimension exploded partial views of the multi-phase medium voltage contactor of FIG. 1.
Figure 5:
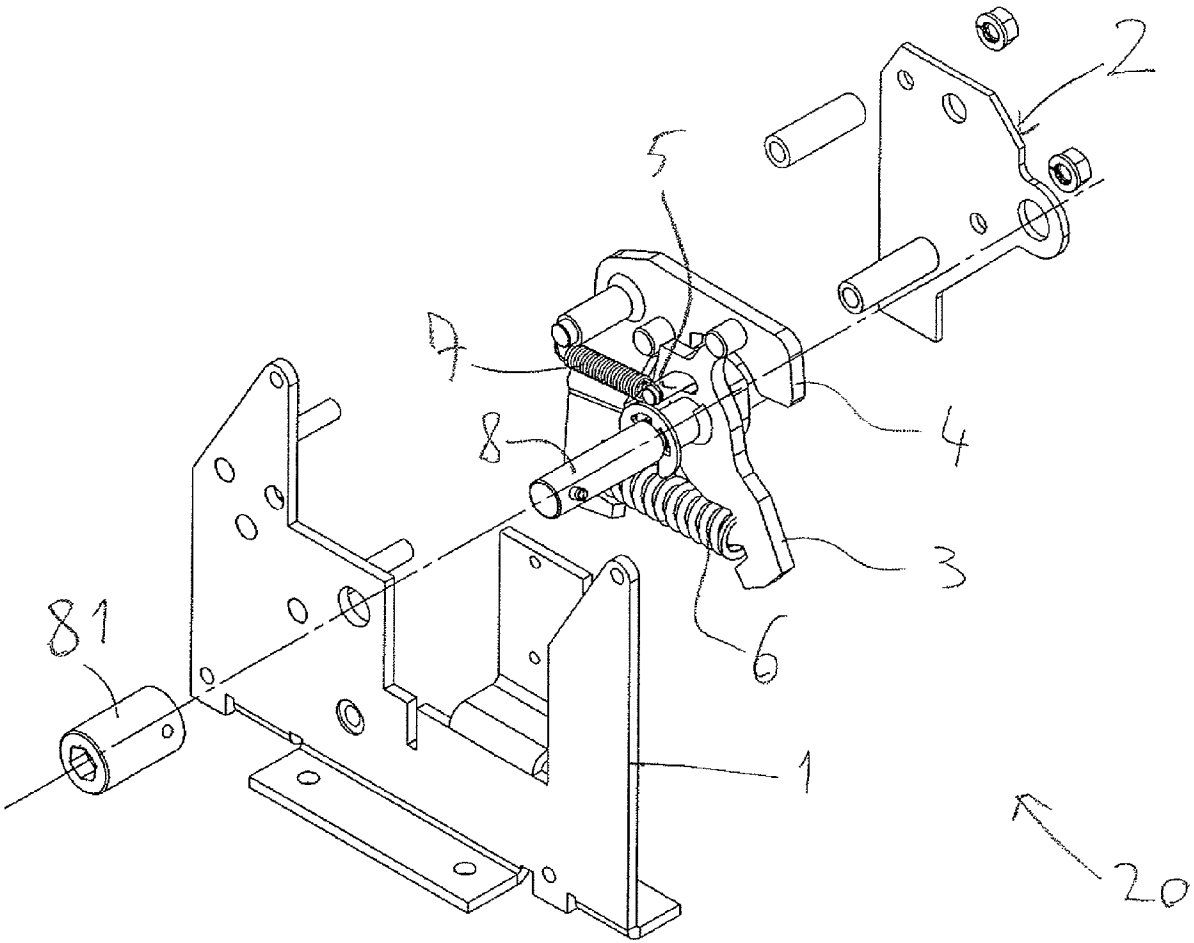

Each phase comprises a fixed contact 103 and a corresponding movable contact 104 which is positionable between:

- an open position, in which said movable contact 104 is operatively disconnected from the fixed contact 103 (position of FIG. 1);
- a closed position, in which said movable contact 104 is operatively connected to said fixed contact 103 (position not shown).

The contacts 103, 104 are positioned inside respective vacuum chambers or bulbs 102 of type which is per se known.

The multi-phase medium voltage contactor 100 comprises an electromagnetic actuator 10 capable to move the movable contacts 104 and positionable between an open position, in which said movable contacts 104 are in the open position as well (i.e. electrically separated from the fixed contacts 103), and a closed position, in which the movable contacts 104 are in closed position as well (i.e. electrically coupled with the fixed contacts 104). The electromagnetic actuator 10 is preferably of the type with permanent magnets, as per se known in the art. The electromagnetic actuator 10 preferably comprises a housing 11 inside which the main components of the electromagnetic actuator 10, such as the permanent magnets, are contained.

In the present embodiment, the electromagnetic actuator 10 is for instance of the type comprising an electromagnetic yoke, e.g. with two E-shaped parts, configured so as to present a cavity, and a movable armature 115 which is accommodated in an axially displaceable manner inside the cavity and is operatively connected, through coupling means, to the movable contacts 104.

The electromagnetic actuator 10 comprises preferably at least one coil suitable to be energized during operation; preferably, there are provided two coils, namely a first opening coil 120 which is suitable to be energized during opening of the contactor, and a second closing coil 121 which is suitable to be energized when closing. Preferably, the coils 120, 121 are placed in the cavity; the coils 120, 121 are spaced apart from each other along the axis 130, which in the present embodiment is also the axis of displacement of the armature 115.

Advantageously, the electromagnetic actuator 10 also comprises at least one permanent magnet which is coupled to the yoke, and is devoted to directly hold the movable armature 115 either in a first stable position in which the fixed and movable contacts 103, 104 are electrically coupled and in a second stable position in which the movable contacts 103, 104 are electrically separated from each other. Preferably, there are provided two permanent magnets of the type having their north poles facing each other and with the movable armature 115 positioned therebetween.

Figure 6:
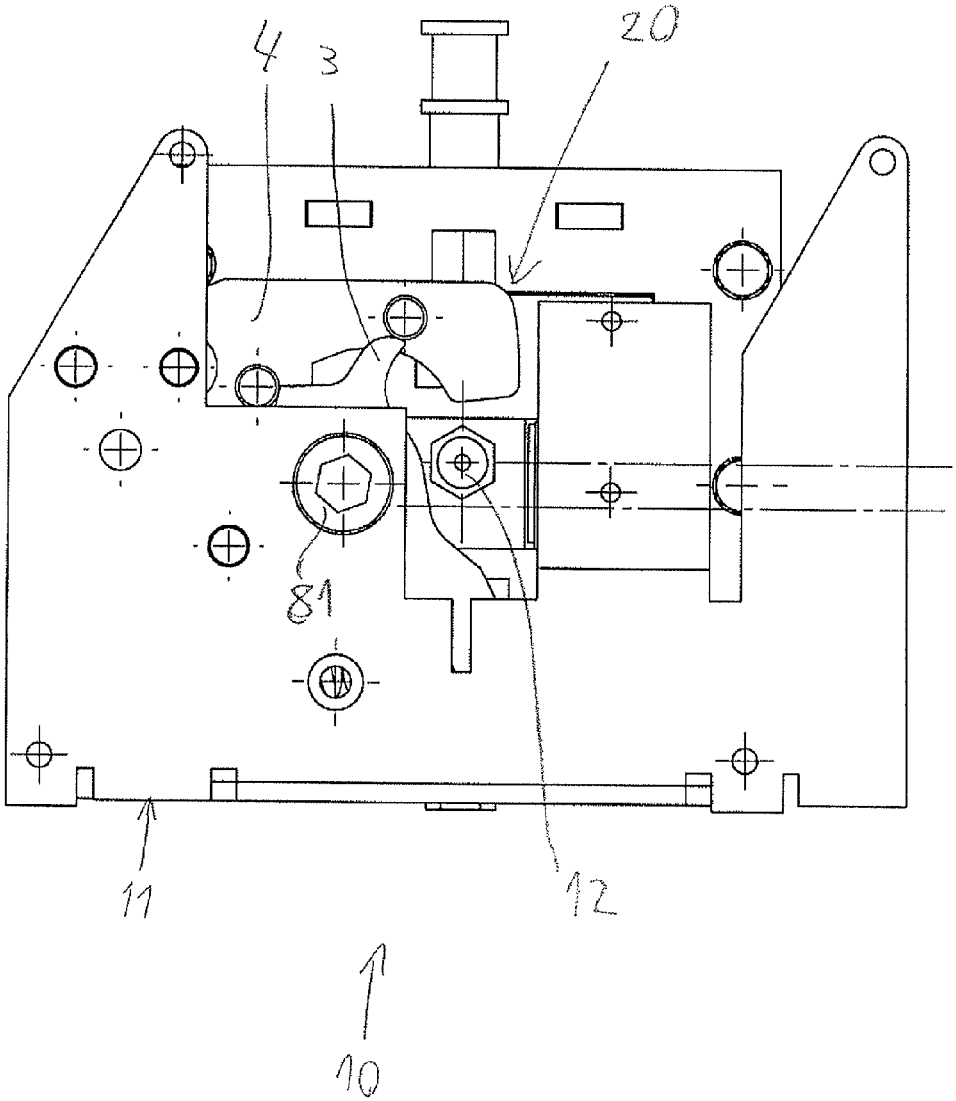
FIGS. 6 and 7 are side partial views of the multi-phase medium voltage contactor of FIG. 1 respectively in closed and opened position.
Figure 7:
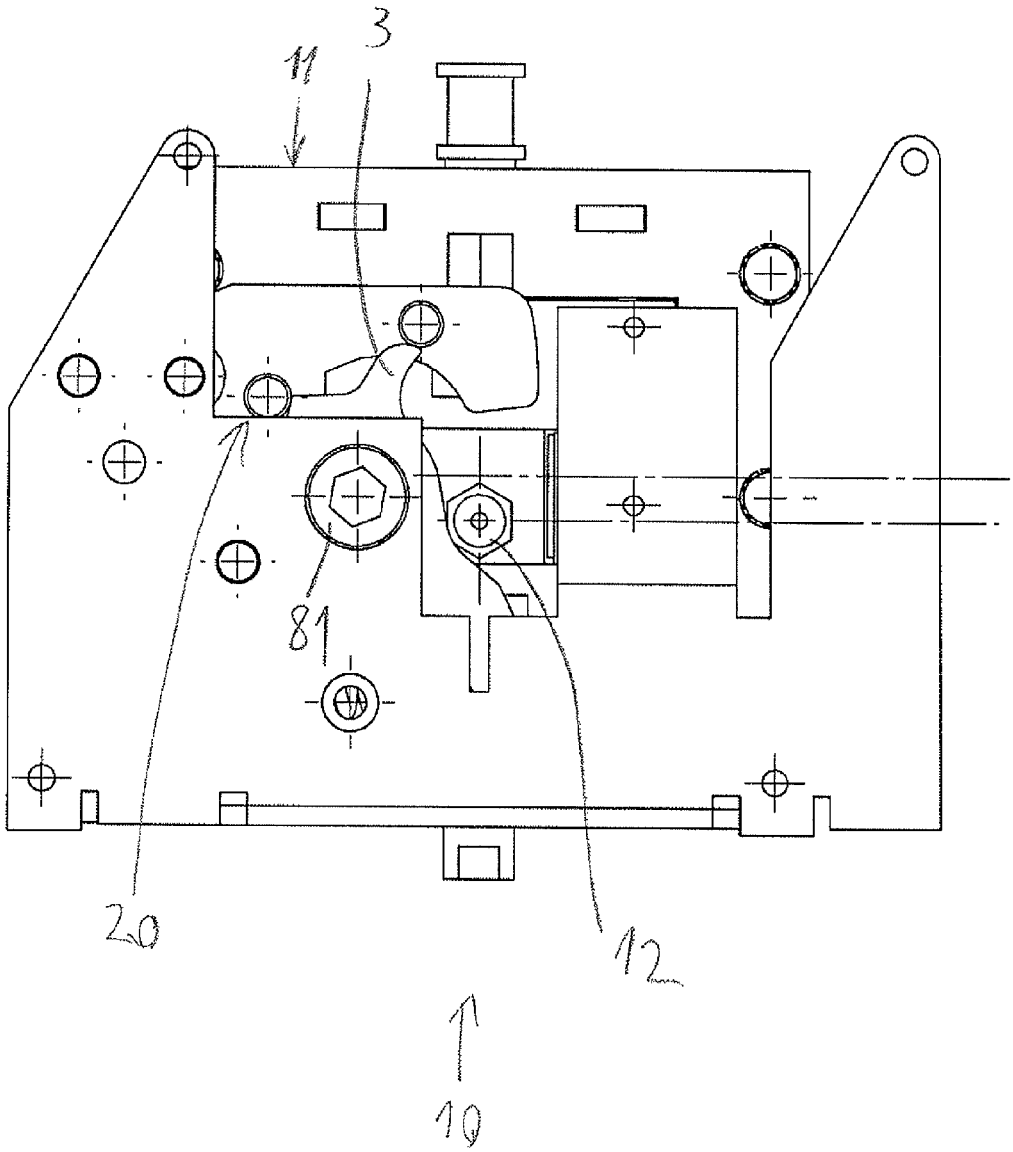

The electromagnetic actuator 10 comprises a pin 12 (not shown in FIG. 1) passing through the housing 11, whose function will be described later, and is kinematically movable between:

- an open position, corresponding to the open position of the movable contacts 104, in which the pin 12 is positioned at a first height, in the present case a higher height illustrated in FIG. 6;
- a closed position, corresponding to the closed position of the movable contacts 104, in which the pin 12 is positioned at a second height, in the present case a lower height illustrated in FIG. 7.

Under emergency situations, e.g. when the feeding auxiliary power is absent, the electromagnetic actuator 10 is kinematically movable also by means of the pin 12 which is kinematically movable, in turn, by a manual opening device 20 (not shown in FIG. 1) so as to provide for an operative connection between said manual opening device 20 and said electromagnetic actuator 10 in a way that forces said electromagnetic actuator 10 to be opened according to the movement of said manual opening device 20.

The manual opening device 20 comprises two containment or supporting walls 1, 2 acting as housing (according to different embodiments, other kinds of housings could be provided).

The manual opening device 20 comprises a kinematic mechanism presenting an operating shaft 8, which is directly jointed e.g. to a head component 81 presenting a cavity for a manual tool to be inserted, such of the allen spanner type. Thus, the operating shaft 8 is rotatable under the direct effect of a user force applied thereon.

The kinematic mechanism of the manual opening device 20 comprises also first lever means which are directly coupled to said operating shaft 8. Said first lever means comprise a rotatable first lever 3 directly connected to said operating shaft 8 so as they can rotate together. The rotation axis of the first lever 3 is coincident with the rotation axis of the operating shaft 8.

The kinematic mechanism of the manual opening device 20 comprises also second lever means movable for effect of said first lever 3 and operatively coupled to said actuator 10, in particular through said pin 12. Said second lever means are represented, in the present embodiment, by a second lever 4 which is rotatably hinged with a rotation axis parallel to and different from the rotation axis of said first lever 3.

It has to be noticed that said second lever 4 is shaped so as its rotation is capable to hit the pin 12 and to push it from the closed position (FIG. 6) to the open position (FIG. 7).

The kinematic mechanism of the manual opening device 20 comprises also blocking means movable by said first lever 3. The blocking means comprise a blocking lever 5 which is rotatably hinged to the same rotation axis of the first lever 3.

Advantageously, the blocking lever 5 has a profile shaped with a cam 51 and a step 52 adjacent the cam 51.

The blocking lever 5 and the second lever 4 are positioned so that the blocking lever 5 is capable of interfering with the second lever 4 when said second lever 4 rotates from said closed position towards said open position. In particular, the profile of the blocking lever 5 is such that the cam 51 is capable of blocking said rotation of the second lever 4.

In turn, advantageously, the second lever 4 comprises a profile with a countercam 41 blockable by said cam 51 and a counterstep 42 engageable by said step 52 so as to unblock said second lever 4.

Advantageously, the blocking lever 5 comprises a protuberance 53. According to this embodiment, the protuberance 53 protrudes in a direction parallel to the rotation axis of the blocking lever 5. Advantageously, the protuberance 53 is placed eccentrically with respect to the blocking lever 5 and is free to be moved within a slot 33 of the first lever 3. In this way, the protuberance 53 is engageable to/draggable by said first lever 3, but only when said first lever 3 moves of an amount of rotation bigger than a predetermined threshold.

The kinematic mechanism comprises advantageously primary elastic means which include, according to the present embodiment, a primary spring 6 which is interposed between said first lever 3 and said second lever 4.

Said primary spring 6 is compressible by said first lever 3 and is capable to store elastic energy; a part of said elastic energy is capable of forcing a snap movement onto said second lever 4 when the engagement of cam 51 and countercam 41 is substituted by the engagement of step 52 and counterstep 42.

It will be seen that, preferably, the primary spring 6 is also capable to determine a return movement of said first lever 3 and second lever means 4 thanks to the elastic energy that is capable to store.

Advantageously, the kinematic mechanism comprises secondary elastic means which in the present embodiment are represented by a secondary spring 7. The secondary spring 7 preferably comprises a first end coupled to the blocking lever 5, in particular to the protuberance 53, and a second end coupled to the second lever 4.

Advantageously, the secondary spring 7 is capable to determine a return movement of said blocking lever 5 and a consequent return movement of said second lever 3 by engagement of said second lever 3 with said blocking means 5.

With reference to FIGS. 8-13, the functioning of the manual opening device 20 is shown in a sequence of manually opening closed contacts.

Figure 8:
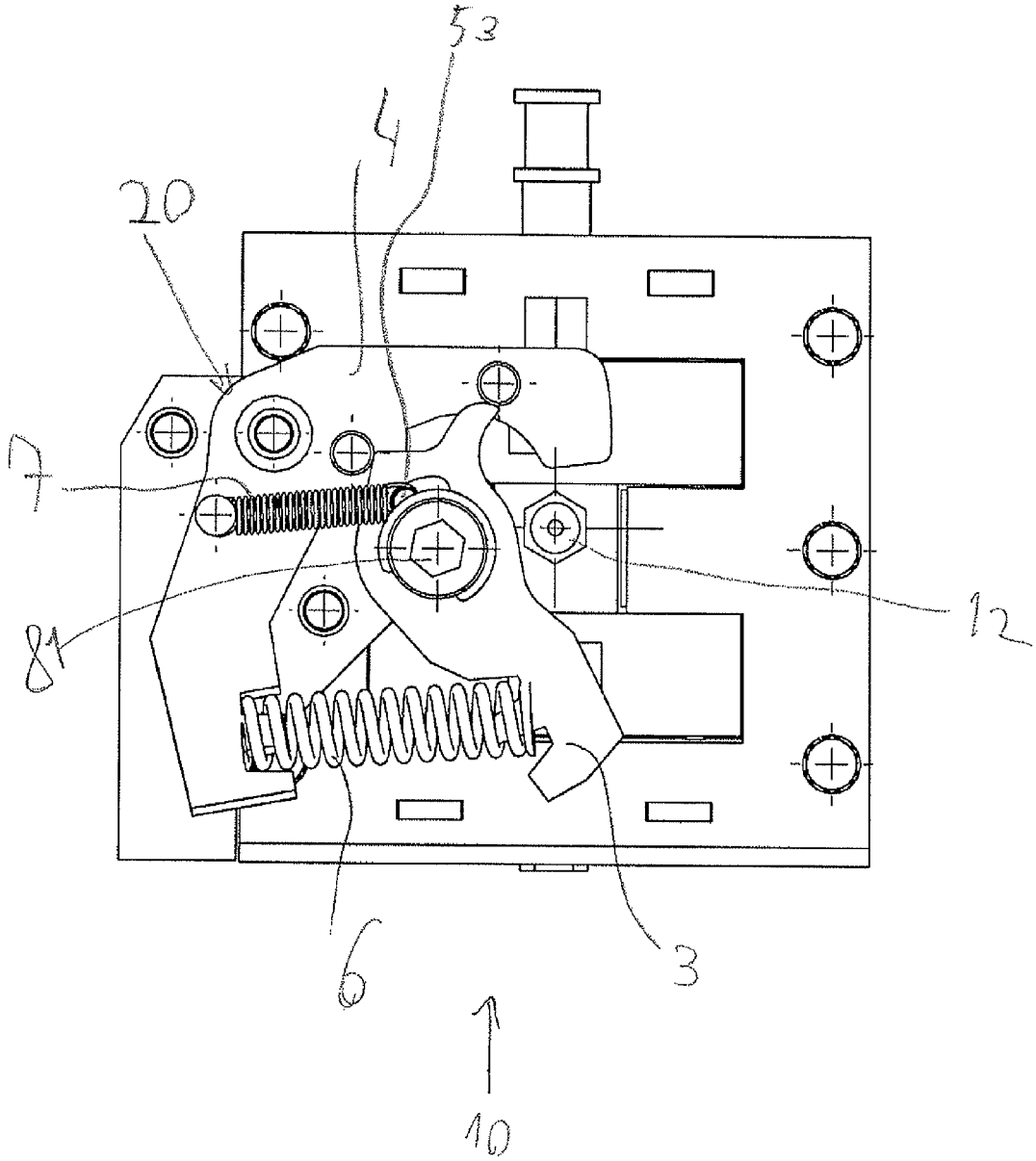
FIGS. 8-13 are partial side views of the multi-phase medium voltage contactor of FIG. 1 in a sequence from the closed to the opened position.

In FIG. 8 the pin 12 is in a closed position; moreover, it does not have any contact with the second lever 4. Both the primary spring 6 and the secondary spring 7 are in a rest position, in which no energy is stored.

Figure 9:
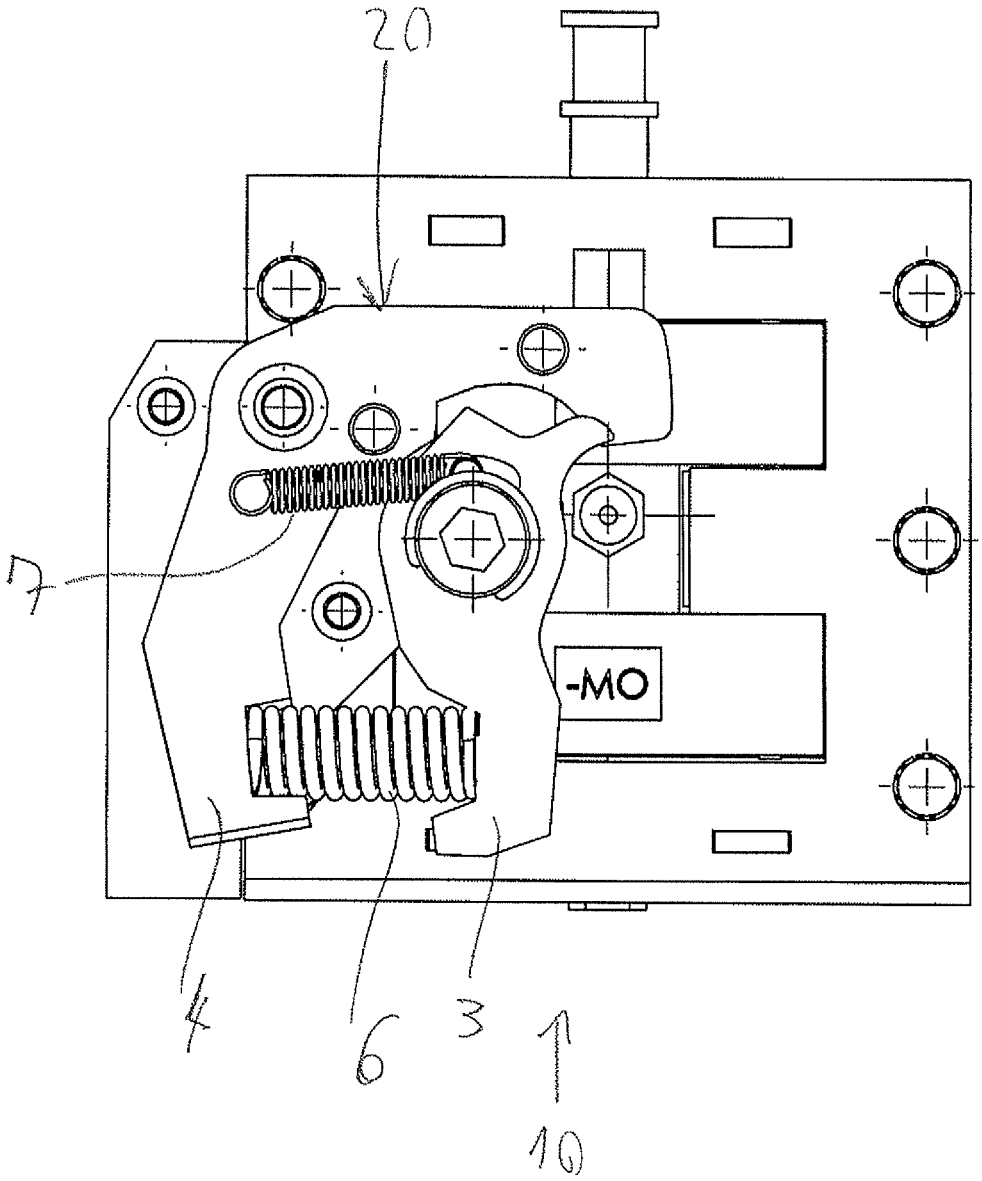

In FIG. 9 is depicted a successive instant following a user action of rotating the operating shaft 8: the primary spring 6 is compressed, thus storing elastic energy, and at the same time the same primary spring 6 pushes the second lever 4 so as to tend to rotate.

Figure 10:
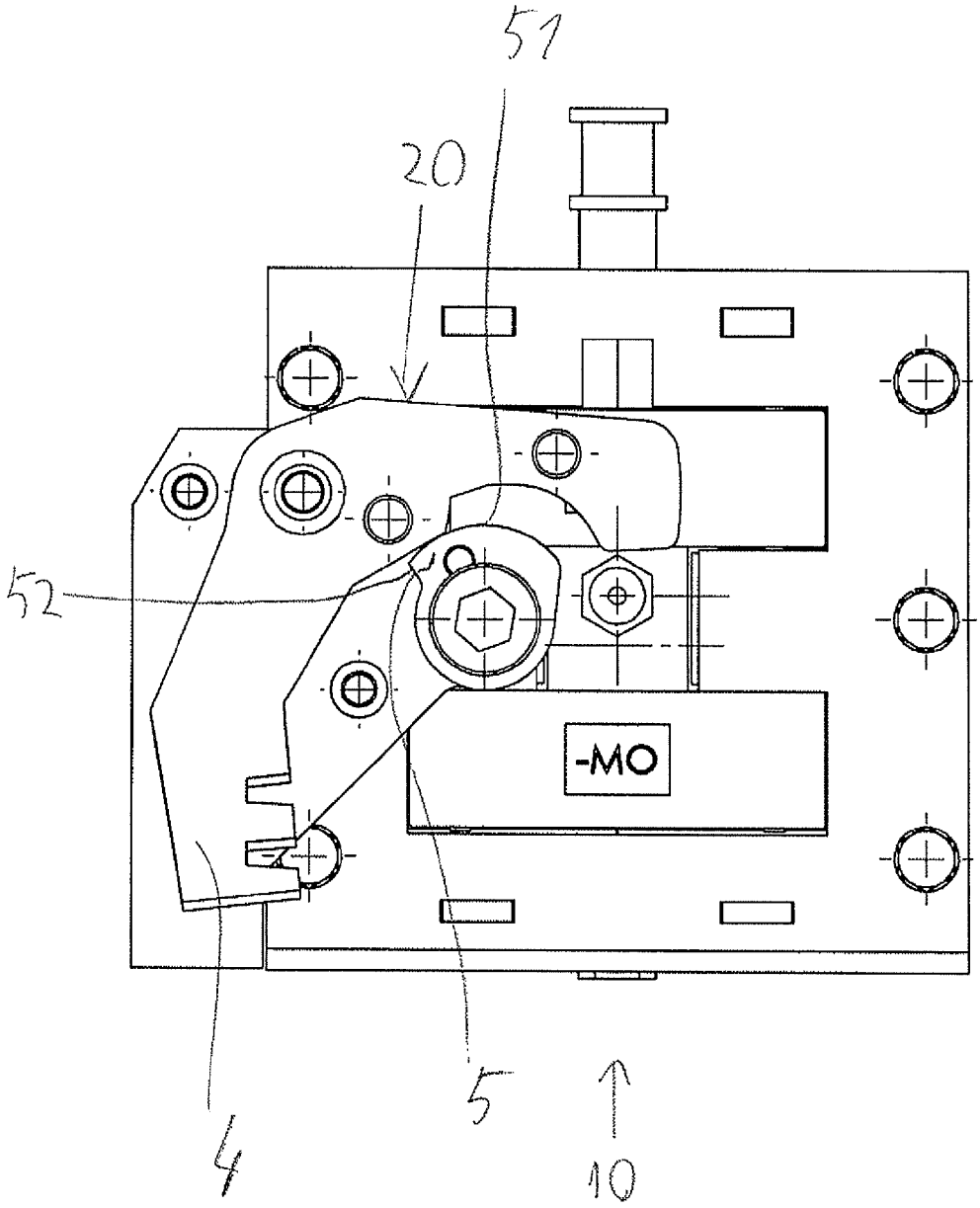

However, as depicted in FIG. 10, the second lever 4 does not actually rotate to the point of hitting the pin 12, since the second lever 4 is blocked by the engagement with the cam 51 of the blocking lever 5.

The blocking lever 5 is not connected to the operating shaft 8; however, the protuberance 53, which protrudes through the slot 33 of the first lever 3, is engageable by the internal walls of the slot 33.

Figure 11:
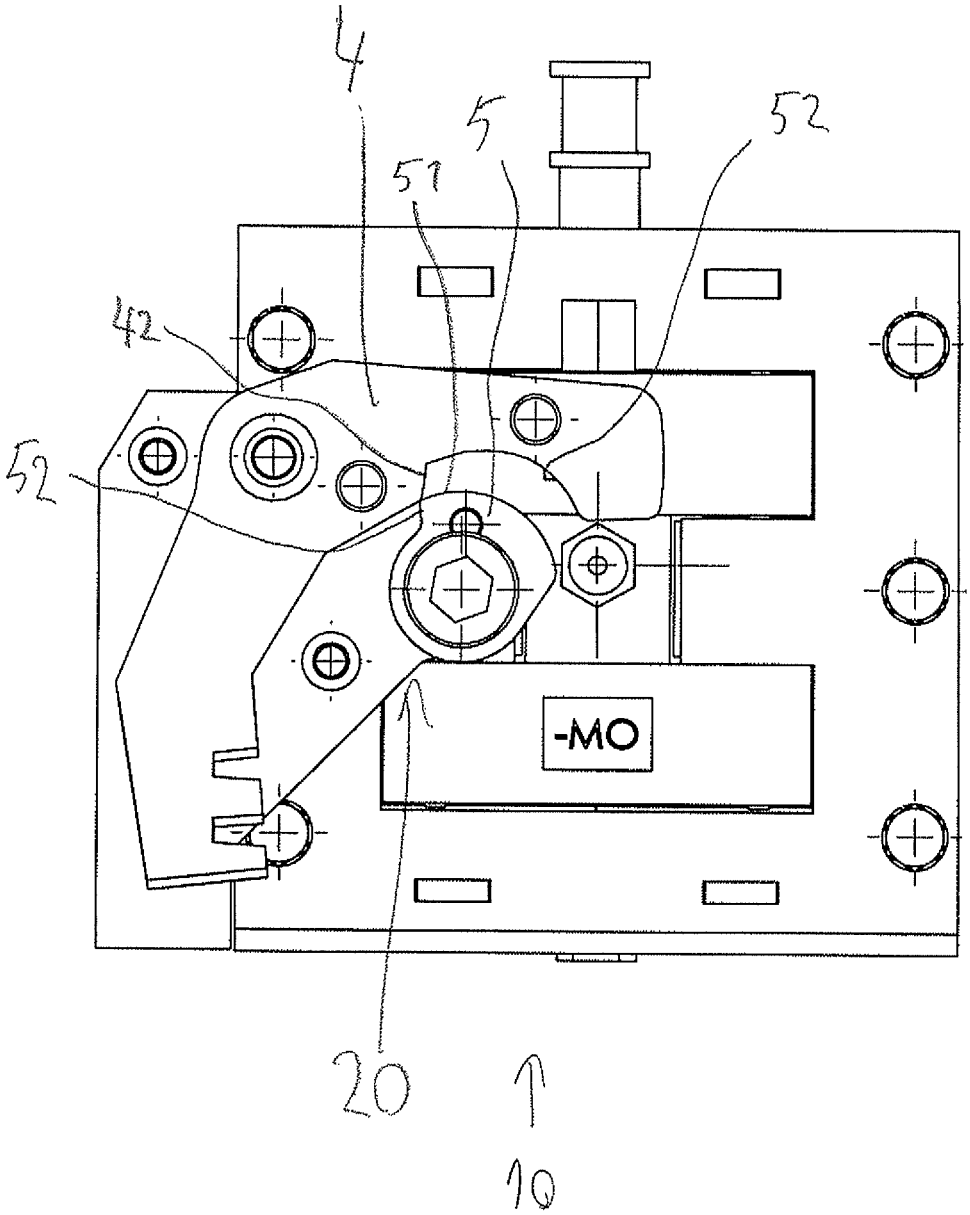

Thus, a rotation of the blocking lever 5 is determined by the first lever 3, said rotation being understandable by the comparison between the FIG. 10 and the FIG. 11 which depicts a subsequent instant with respect to FIG. 10.

Figure 12:
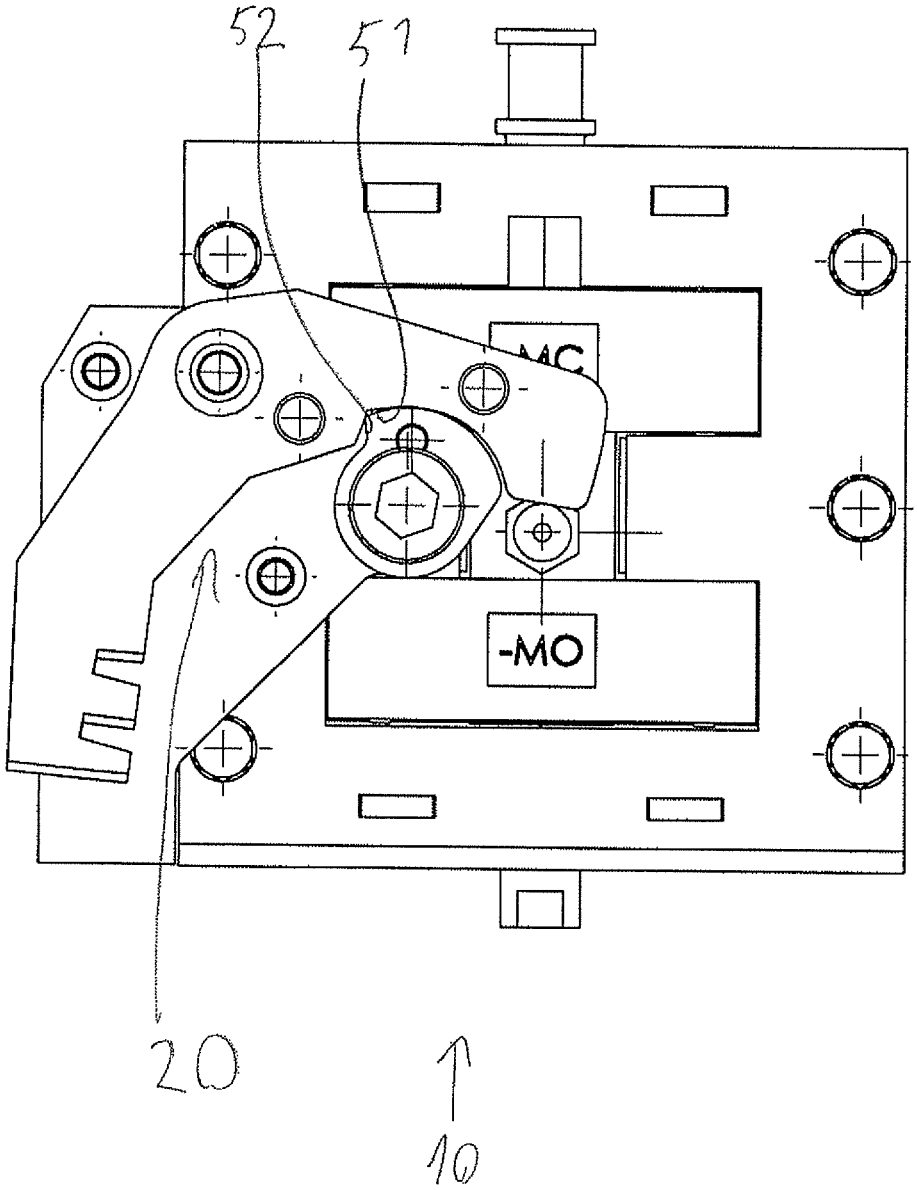

In a subsequent instant, the rotation imposed to the blocking lever 5 implies that the cam 51 is no more engaged with the second lever 4, the step 52 being reached in such a way that permits the second lever 4 to rotate under the action of the primary spring 6 and to push the pin 12, so as to determine the movement of the actuator 10 into the open position (FIG. 12).

Advantageously, the primary spring 6 actuates this movement by releasing a part of the stored elastic energy for pushing the pin 12. It has to be noticed that this movement is a snap movement due to the primary spring 6 expanding towards its rest position. This movement is advantageously completely independent from the action of the user that rotates the operating shaft 8.

Figure 13:
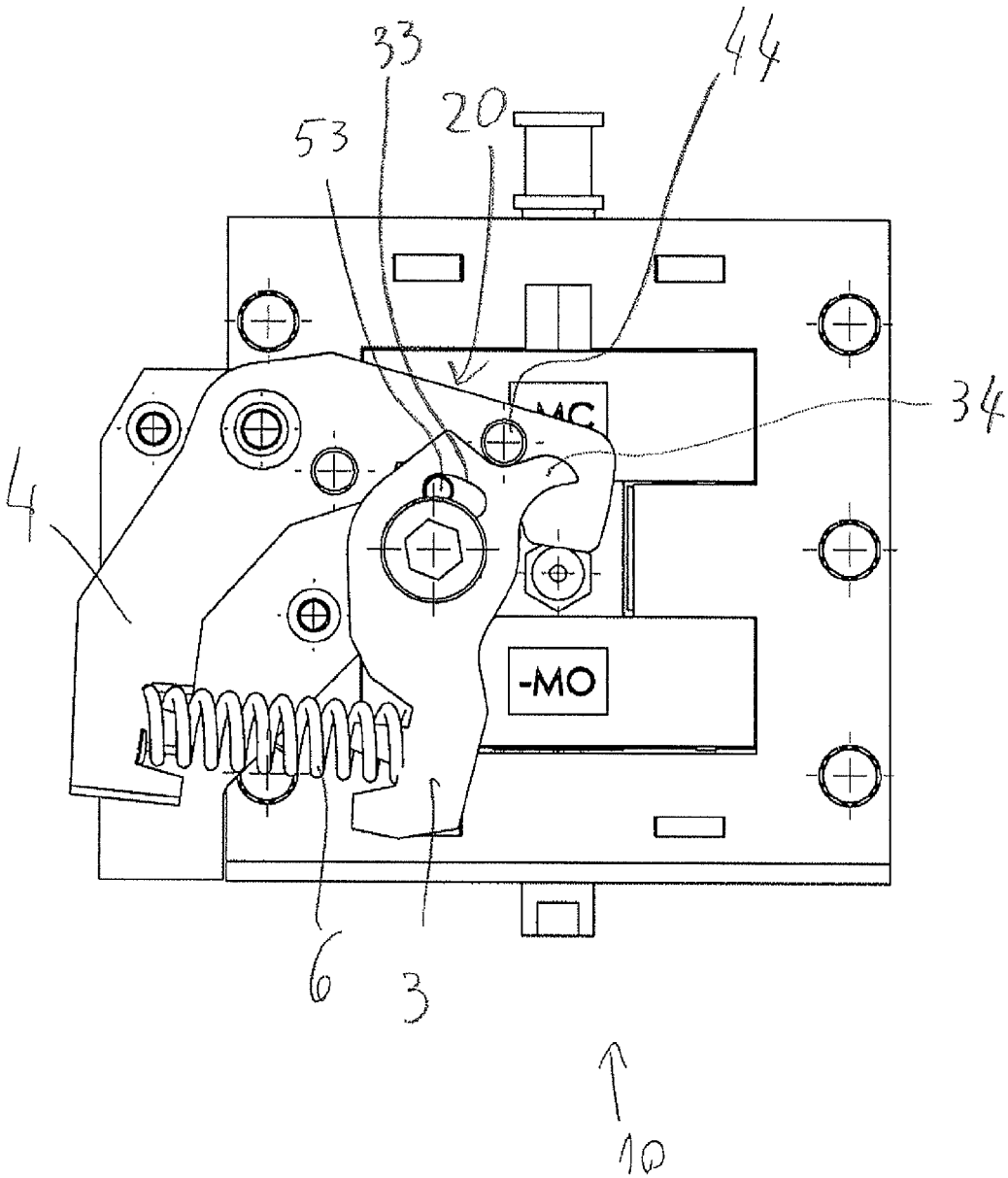

According to the present embodiment the movement ends when, as depicted by FIG. 13, an a first stop protrusion 34 of the first lever 3 and a second stop protrusion 44 of the second lever 4 interfere without giving a possibility of further rotation in the same angular direction.

Figure 14:
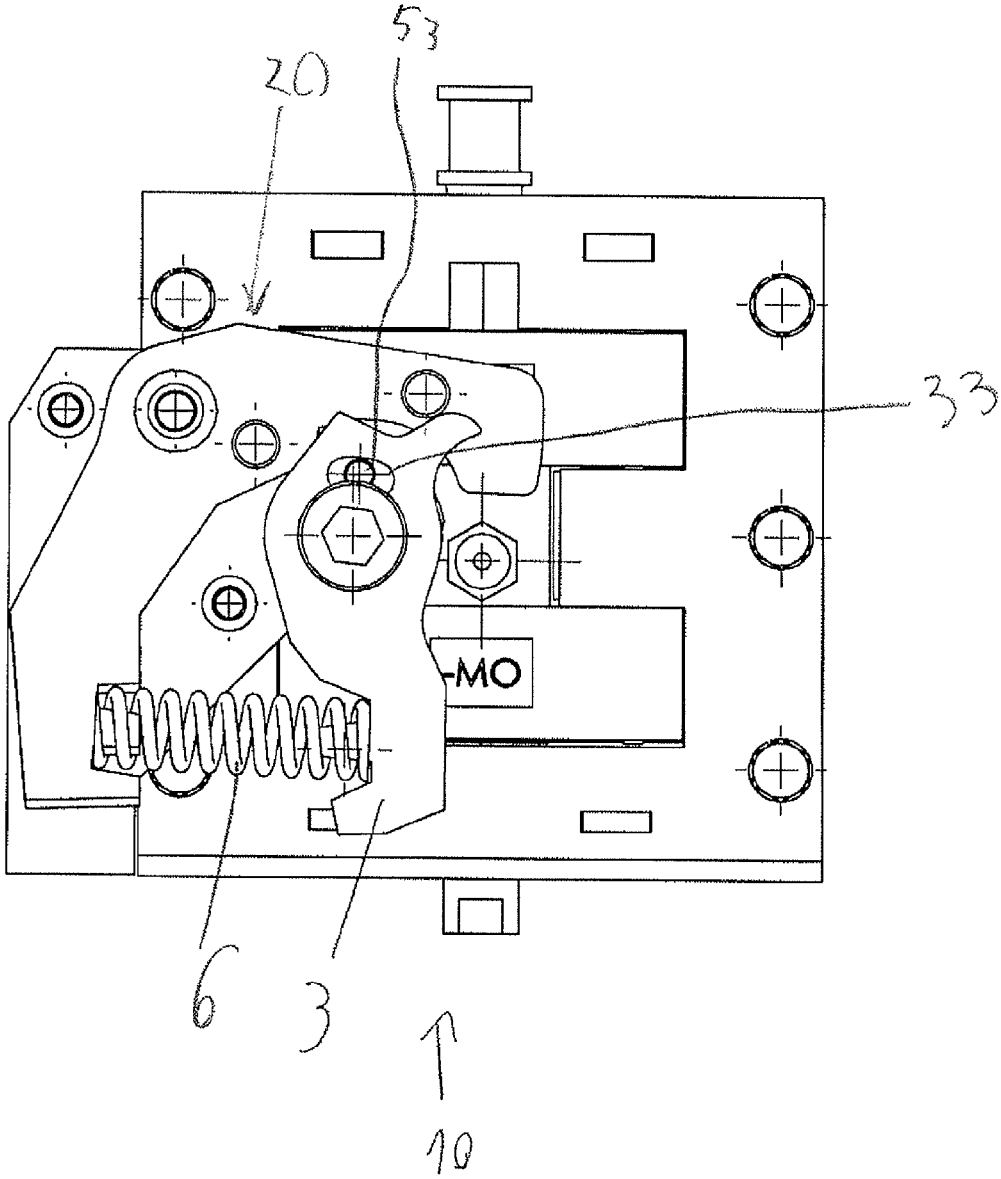
FIGS. 14-15 are partial side views of the multi-phase medium voltage contactor of FIG. 1 in a sequence from the opened to the closed position.
Figure 15:
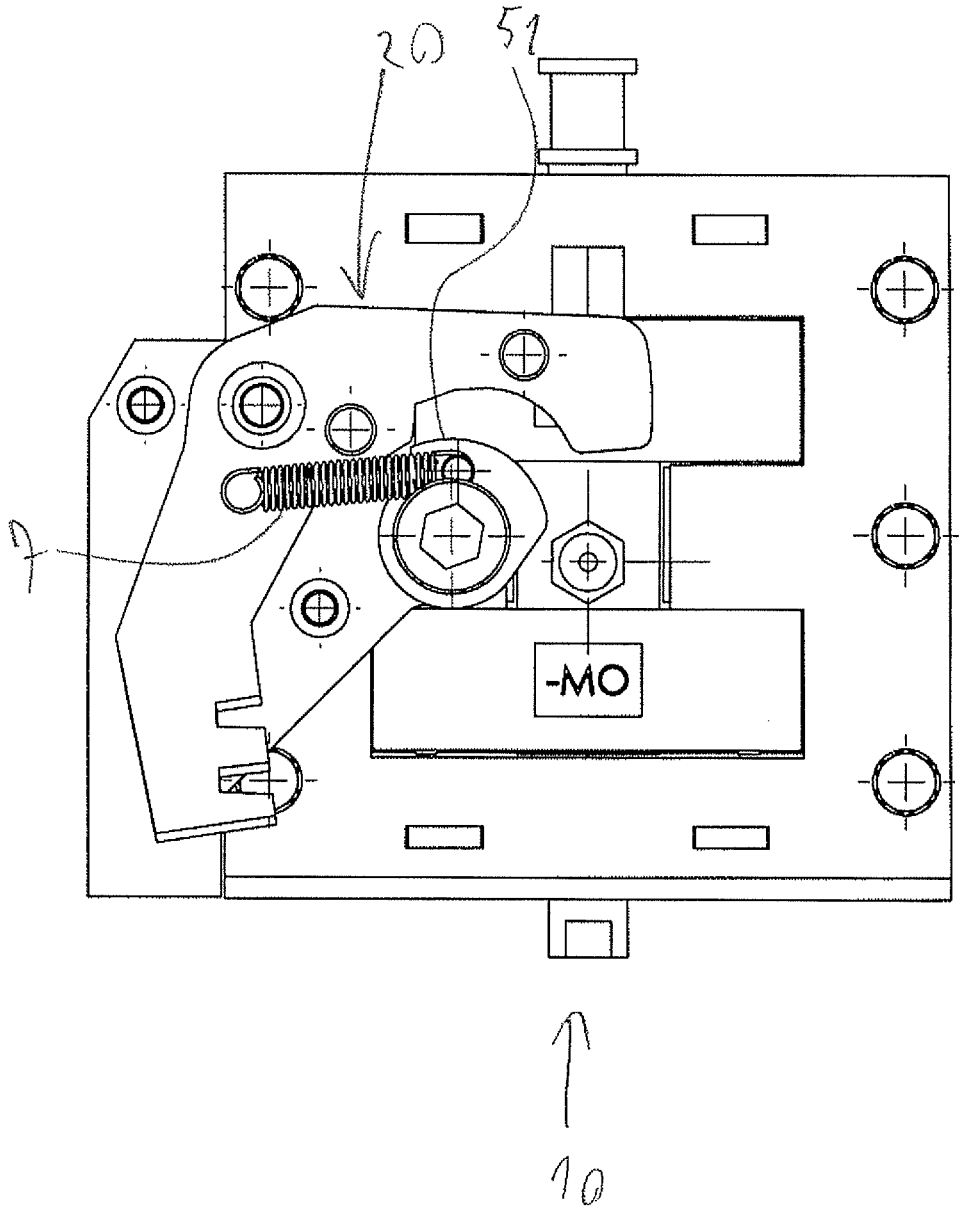

FIGS. 14 and 15 depict the return movement of the kinematic mechanism during subsequent instants according to the present embodiment.

This is advantageously due to the remaining elastic energy stored in the primary spring 6 which tends to return to its rest position, and to the secondary spring 7 which tends to return to its rest position, as well. Said secondary spring 7 is advantageously capable to determine a return movement of the blocking lever 5 by pulling the protuberance 53.

It has to be noticed that in this way the rotation speed is not imposed by the human operation, but instead by the parameters of the kinematic mechanism, among them being the parameters of the primary spring, the parameters of the levers, the length of the slot, and so on.

The contactor 100 thus conceived is susceptible to numerous changes and variants, all of which are in the scope of the inventive concept as defined by the appended claims; additionally, all details can be replaced by other equivalent technical elements. For example, the number of elements as well as their configuration can be varied provided they are suitable for their scope; further, it is possible to perform any combination of the illustrative examples previously described. In practice, the materials, as well as the dimensions, can be of any kind depending on the requirements and state of the art.

The invention claimed is:

1. A multi-phase Medium Voltage Contactor comprising:

for each phase, a fixed contact and an associated movable contact positionable between an open position, in which it is operatively disconnected from said fixed contact, and a closed position, in which it is operatively connected to said fixed contact;

an electromagnetic actuator operatively connected to said movable contact and positionable between a first, open position corresponding to the open position of said movable contact, and a second, closed position corresponding to said closed position of said movable contact;

a manual opening device operatively connected to said actuator;

wherein said manual opening device comprises a kinematic mechanism having:

an operating shaft;

first lever means movable by said operating shaft;

second lever means movable by said first lever means and operatively coupled to said electromagnetic actuator, blocking means movable by said first lever means between a first position in which said blocking means lock said second lever means and a second position in which said second lever means are released to exert force on a pin of the electromagnetic actuator, thereby determining the positioning of said electromagnetic actuator from said closed position into said open position.

2. A multi-phase Medium Voltage Contactor according to claim 1, wherein said blocking means comprise a profile with a cam and a step, so that said second lever means are blockable by engagement with said cam and unblockable at the reaching of said step.

3. A multi-phase Medium Voltage Contactor according to claim 2, wherein said blocking means comprise a protuberance engageable to/draggable by said first lever means.

4. A multi-phase Medium Voltage Contactor according to claim 2, wherein said kinematic mechanism comprises primary elastic means interposed between said first lever means and said second lever means.

5. A multi-phase Medium Voltage Contactor according to claim 2, wherein said first lever means comprise a rotatable first lever connected to said operating shaft.

6. A multi-phase Medium Voltage Contactor according to claim 1, wherein said blocking means comprise a protuberance engageable to/draggable by said first lever means.

7. A multi-phase Medium Voltage Contactor according to claim 6, wherein said protuberance is placed eccentrically with respect to said blocking lever, said first lever means comprising a slot inside which said protuberance is movable.

8. A multi-phase Medium Voltage Contactor according to claim 6, wherein said kinematic mechanism comprises primary elastic means interposed between said first lever means and said second lever means.

9. A multi-phase Medium Voltage Contactor according to claim 6, wherein said first lever means comprise a rotatable first lever connected to said operating shaft.

10. A multi-phase Medium Voltage Contactor according to claim 1, wherein said kinematic mechanism comprises primary elastic means interposed between said first lever means and said second lever means.

11. A multi-phase Medium Voltage Contactor according to claim 10, wherein said primary elastic means are compressible by said first lever means so as to store elastic energy, at least a part of said elastic energy being capable to determine a snap movement of said second lever means.

12. A multi-phase Medium Voltage Contactor according to claim 11, wherein at least a further part of said elastic energy is capable to determine a return movement of said first lever means and second lever means.

13. A multi-phase Medium Voltage Contactor according to claim 12, wherein said kinematic mechanism comprises secondary elastic means with a first end coupled to said blocking means and a second end coupled to said second lever means.

14. A multi-phase Medium Voltage Contactor according to claim 11, wherein said kinematic mechanism comprises secondary elastic means with a first end coupled to said blocking means and a second end coupled to said second lever means.

15. A multi-phase Medium Voltage Contactor according to claim 14, wherein said secondary elastic means are capable to determine a return movement of said blocking means and a consequent return movement of said second lever means by engagement of said second lever means with said blocking means.

16. A multi-phase Medium Voltage Contactor according to claim 11, wherein said first lever means comprise a rotatable first lever connected to said operating shaft.

17. A multi-phase Medium Voltage Contactor according to claim 10, wherein said first lever means comprise a rotatable first lever connected to said operating shaft.

18. A multi-phase Medium Voltage Contactor according to claim 1, wherein said first lever means comprise a rotatable first lever connected to said operating shaft.

19. A multi-phase Medium Voltage Contactor according to claim 18, wherein said second lever means comprise a second lever rotatably hinged with a rotation axis parallel to the rotation axis of said first lever.

20. A multi-phase Medium Voltage Contactor according to claim 6, wherein said blocking means comprise a blocking lever rotatably hinged to the same rotation axis of said first lever.

21. A multi-phase Medium Voltage Contactor comprising:

for each phase, a fixed contact and an associated movable contact positionable between an open position, in which it is operatively disconnected from said fixed contact, and a closed position, in which it is operatively connected to said fixed contact;

an electromagnetic actuator operatively connected to said movable contact and positionable between a first, open position corresponding to the open position of said movable contact, and a second, closed position corresponding to said closed position of said movable contact;

a manual opening device operatively connected to said actuator;

wherein said manual opening device comprises a kinematic mechanism having:

an operating shaft;

first lever means movable by said operating shaft;

second lever means movable by said first lever means and operatively coupled to said electromagnetic actuator, blocking means movable by said first lever means between a first position in which said blocking means lock said second lever means and a second position in which said second lever means are released to exert force on a pin of the electromagnetic actuator, thereby determining the positioning of said electromagnetic actuator from said closed position into said open position;

wherein said kinematic mechanism comprises:

primary elastic means interposed between said first lever means and said second lever means; and secondary elastic means with a first end coupled to said blocking means and a second end coupled to said second lever means.

22. A multi-phase Medium Voltage Contactor according to claim 21, wherein said secondary elastic means are capable to determine a return movement of said blocking means and a consequent return movement of said second lever means by engagement of said second lever means with said blocking means.

* * * * *